US007644551B2

(12) United States Patent
Crittenden

(10) Patent No.: US 7,644,551 B2
(45) Date of Patent: Jan. 12, 2010

(54) DOUBLE SKIN DOOR APPARATUS

(75) Inventor: Jerry G. Crittenden, Phoenix, AZ (US)

(73) Assignee: Masonite International Corporation, Ontario (CA)

( * ) Notice: Subject to any disclaimer, the term of this patent is extended or adjusted under 35 U.S.C. 154(b) by 1023 days.

(21) Appl. No.: 10/456,915

(22) Filed: Jun. 9, 2003

(65) Prior Publication Data

US 2004/0035085 A1 Feb. 26, 2004

Related U.S. Application Data

(63) Continuation-in-part of application No. 10/308,263, filed on Nov. 27, 2002, now Pat. No. 6,820,308, which is a continuation-in-part of application No. 10/223,744, filed on Aug. 20, 2002, now abandoned.

(51) Int. Cl.
*E04C 2/10* (2006.01)

(52) U.S. Cl. ..... 52/455; 52/309.4; 52/309.15

(58) Field of Classification Search ..... 52/783.11, 52/783.12, 783.14, 783.18, 784.1, 784.14, 52/784.15, 455–457, 454, 309.11, 309.9, 52/782.1, 509.9, 784.16
See application file for complete search history.

(56) References Cited

U.S. PATENT DOCUMENTS 4,265,067 A * 5/1981 Palmer ..... 52/309.9
4,811,538 A * 3/1989 Lehnert et al. ..... 52/455
5,074,087 A * 12/1991 Green ..... 52/309.9
5,293,726 A * 3/1994 Schick ..... 52/455
5,438,808 A 8/1995 Costello
5,782,055 A 7/1998 Crittenden
6,161,363 A * 12/2000 Herbst ..... 52/784.15
6,619,010 B2 * 9/2003 Wang Chen ..... 52/784.13

FOREIGN PATENT DOCUMENTS

EP 0 688 639 A2 12/1995
EP 1 190 825 A2 2/2002
EP 1 223 289 A2 7/2002
FR 2 332 142 2/1997

* cited by examiner

*Primary Examiner*—Jeanette E. Chapman
(74) *Attorney, Agent, or Firm*—Berento & White

(57) ABSTRACT

A hollow core door comprises a perimeter frame, and first and second molded skins. Each skin has an exterior surface and an interior surface secured to opposing sides of the frame. At least one of the skins has an outer planar area, an inner planar area, and an asymmetric profile surrounding the inner planar area and interconnecting and integral with the outer planar area and the inner planar area. The asymmetric profile area has a convex portion extending outwardly from and relative to the plane of the outer planar area.

24 Claims, 2 Drawing Sheets

DOUBLE SKIN DOOR APPARATUS

CROSS REFERENCE TO RELATED APPLICATION AND CLAIM TO PRIORITY

This application is a continuation-in-part of application Ser. No. 10/308,263, filed Nov. 27, 2002 now U.S. Pat. No. 6,820,308 for the invention entitled Double Skin Apparatus, which was a continuation-in-part of application Ser. No. 10/223,744, filed Aug. 20, 2002, now abandoned titled Double Skin Door Apparatus, the disclosures of which are incorporated herein by reference and priority to all of which is claimed in accordance with 35 U.S.C. § 120.

FIELD OF THE INVENTION

The present invention is directed to a hollow core door having a perimeter frame and a pair of reverse molded wood composite door skins having an exterior surface and an interior surface secured to opposing sides of the frame. At least one of the skins has an outer planar area, an inner planar area, and an asymmetric profile surrounding the inner planar area, and interconnecting and integral with the outer planar area and the inner planar area. The asymmetric profile area has a convex portion extending outwardly from and relative to the plane of the outer planar area.

BACKGROUND OF THE INVENTION

Man-made boards, such as fiberboard, e.g., medium density fiberboard; hardboard; chipboard; oriented strand board-fiberboard composites; particle board; oriented strand board-particle board composites; and the like, may be formed into articles having contoured portions simulating stiles, rails, panels, or other desired features. Such articles may be formed to include one or more interior depressions or raised contours simulating panels or other decorative features. Such formed depressions and contoured portions may replicate a natural wood paneled door.

With respect to conventional doors, molded door skins may be adhesively secured to a wood frame support structure to produce a finished door. Rails and stiles may also be used to provide additional structural support for the door. Such doors are well known in the art, and provide consumers with an aesthetically appealing, yet cost efficient alternative to traditional, solid wood doors.

For example, U.S. Pat. No. 5,782,055 to Crittenden discloses an asymmetrically formed door and a method of making the door. The asymmetry allows the door portion inwardly from its perimeter frame to warp in response to temperature and humidity conditions without warping the perimeter frame. Accordingly, the door perimeter frame remains in its original planar configuration. The disclosed door comprises a pair of asymmetrically configured skins secured to a perimeter frame, with a foam disposed between the skins. Generally, the door is used as an exterior door. U.S. Pat. No. 5,074,087 to Green discloses a door having a composite construction with a conventional perimeter frame and a pair of molded fiberglass skins secured to the perimeter frame. Within the skins and the perimeter frame is a plastic foam core. U.S. Pat. No. 5,438,808 to Costello discloses a door having a perimeter frame, which is sandwiched between formed metal stampings or body panels. Wood panels or veneers may then be adhesively secured to the metal stampings to provide a wood appearance. Several different exterior configurations are disclosed.

The present invention provides a door comprising a conventional perimeter frame and a pair of reverse molded wood composite skins. The molded skins include asymmetrical configurations and fill elements between selected portions of the skins. The fill portions are disposed adjacent to the asymmetrical elements so as not to interfere with any warping of the asymmetrical elements due to temperature or humidity conditions.

SUMMARY OF THE INVENTION

The present invention relates to a hollow core door comprising a perimeter frame, and first and second reverse molded door skins. Each of the skins has an exterior surface and an interior surface secured to opposing sides of the frame. At least one of the skins has an outer planar area, an inner planar area, and an asymmetric profile surrounding the inner planar area and interconnecting and integral with the outer planar area and the inner planar area. The asymmetric profile area has a convex portion extending outwardly from and relative to the plane of the outer planar area.

The present invention is also directed to a molded door skin comprising an outer planar area, an inner planar area, and an asymmetric profile area surrounding the inner planar area and interconnecting and integral with the outer planar area and the inner planar area. The asymmetric profile area has a convex portion extending outwardly from and relative to the plane of the outer planar area.

A double skin door apparatus is provided, comprising a door frame having opposing sides. A first door skin is secured to one side of the frame. The first door skin has a first asymmetrical profile including a convex portion and a concave portion. A second door skin is secured to an opposing side of the frame, and is spaced from the first door skin. The second door skin has a second asymmetrical profile including a convex portion and a concave portion. The convex portions of the first and second door skins define a first distance, and the concave portions of the first and second door skins define a second distance, wherein the first distance is greater than the second distance. A plate is disposed between the first and second door skins.

A door comprises a perimeter frame having a first face and a second face. The frame has a first width. A first skin having a perimeter planar portion is secured to the first face of the frame. The first skin has an upper convex portion and an upper inner planar portion, a lower convex portion and a lower inner planar portion spaced from the upper convex portion and the upper inner planar portion. A second skin has a perimeter planar portion secured to the second face of the frame. The second skin has an upper convex portion and an upper inner planar portion, a lower convex portion and a lower inner planar portion spaced from the upper convex portion and the upper inner planar portion on the second skin. The upper convex portions of the first and second skins and the inner planar portions of the first and second skins are aligned with each other. Preferably the door skins are molded from a wood composite, such as medium density fiberboard, chip board, flake board, oriented strand board, and the like.

Objects of the present invention include the following: to provide a new and useful door apparatus; to provide a new and useful interior door apparatus; to provide a new and useful door apparatus having a pair of exterior skins secured to a perimeter frame; to provide a new and useful door having a pair of asymmetrically configured outer skins secured to a frame; to provide a new and useful door apparatus including a pair of asymmetrically configured outer skins secured to a perimeter frame in a mirror image orientation; and to provide a new and useful door apparatus having a pair of outer skins having asymmetrical elements secured to a perimeter frame and plates secured to the skins and disposed inwardly adjacent to the asymmetrical elements.

DETAILED DESCRIPTION OF THE FIGURES

DETAILED DESCRIPTION OF THE INVENTION

Figure 1:
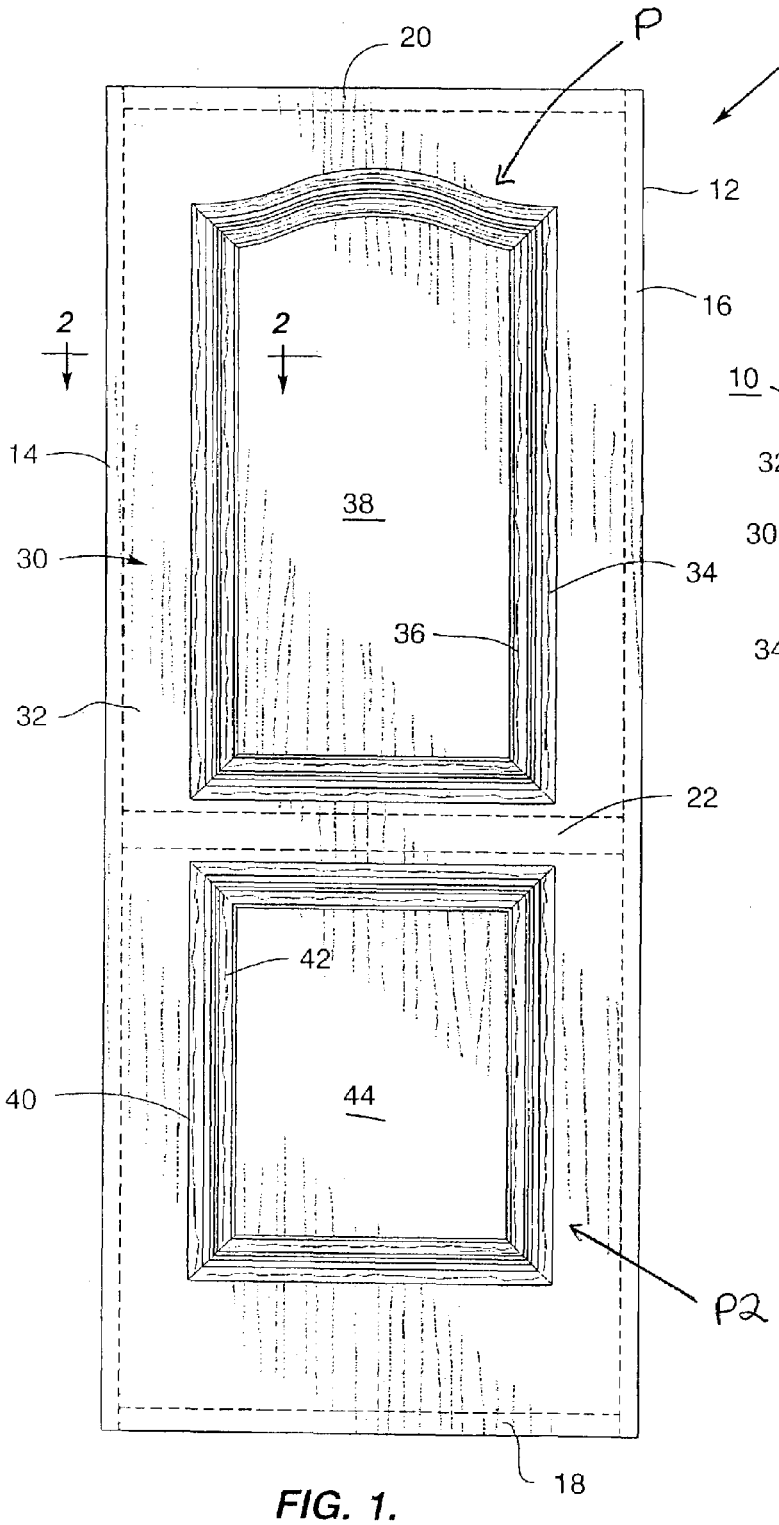
FIG. 1 is an elevational view of a door according to the present invention.

As best shown in FIG. 1, a door 10 comprises a perimeter frame 12, frame 12 having a pair of stiles 14, 16 and a pair of rails 18, 20. Rail 20 is disposed near the top of door 10, and rail 18 is disposed near the bottom of door 10. Stiles 14, 16 and rails 18, 20 are appropriately secured together to define frame 12 of door 10. Frame 12 may also include an intermediate rail 22 disposed intermediate rails 18, 20 and extending fully between stiles 14, 16. Preferably, intermediate rail 22 extends parallel to top and bottom rails 18, 20. As well known in the art, a handle set (not shown) may be secured to door 10 at intermediate rail 22. Rail 22 allows door 10 to be hung as either a right hand or a left hand door. Since rail 22 extends fully between stiles 14, 16, a handle set may be secured to door 10 adjacent either stile 14 or stile 16.

Figure 2:
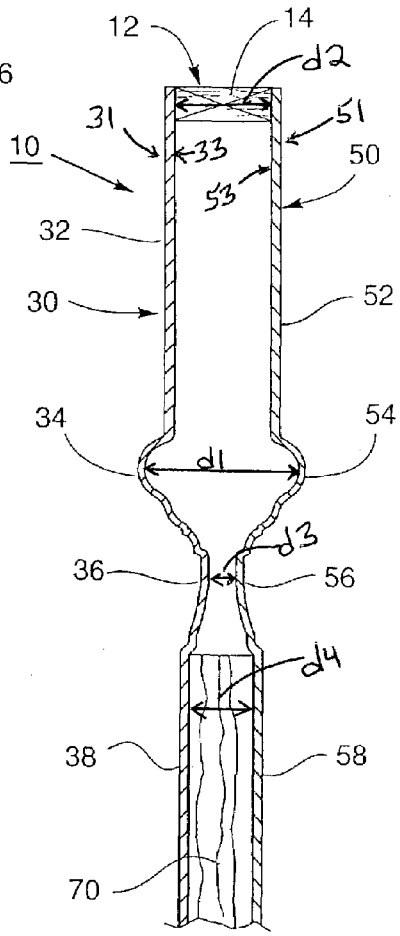
FIG. 2 is a fragmentary cross-sectional view taken along line 2-2 of FIG. 1 and viewed in the direction of the arrows.

Preferably, stiles 14, 16, rails 18, 20, and intermediate rail 22 are made of wood or wood product. Door 10 is particularly well suited as an interior door, and may be referred to as a hollow core door. Door 10 further comprises two skins 30, 50. Each of skins 30, 50 has an exterior visible surface 31, 51 and an interior surface 33, 53 for securing to opposite sides of frame 12, as best shown in FIG. 2. Skins 30, 50 may be secured to frame 12 so that they are mirror images of each other.

Skin 30 includes an outer planar area 32. Inwardly from outer planar area 32 is an asymmetrical profile P formed in skin 30. Asymmetrical profile P includes a convex portion 34 and a concave portion 36. The particular configuration of convex portion 34 and concave portion 36 may vary depending on consumer preference. Inwardly from concave portion 36 is an inner planar area 38. It can be seen from FIG. 2 that the planar areas 32 and 38 have a thickness exceeding the thickness of concave portion 34 and convex portion 38. Therefore, inner planar area 38 is disposed within the perimeter of asymmetrical profile P and is inwardly spaced relative to planar portion 32. That is, asymmetrical profile P comprises a closed area relative to exterior surface 31. This closed area may be either regular or irregular, depending on consumer preference. For example, asymmetrical profile P may define a rectangular closed area, or asymmetrical profile P may define a closed area having a curved side, as shown in FIG. 1. In either case, asymmetrical profile P defines a continuous or closed loop, with inner planar area 38 disposed within the closed loop.

Door 10 may include more than one asymmetrical profile portion P. For example, door 10 shown in FIG. 1 includes asymmetrical profile P defined by convex portion 34 and concave portion 36, as described above. Asymmetrical profile P is disposed in an upper portion of door 10, preferably above intermediate rail 22 and below rail 20. In addition, door 10 includes a second asymmetrical profile portion P2 disposed below intermediate rail 22 and above rail 18. Asymmetrical profile portion P2 may have a different closed loop configuration and shape compared to asymmetrical profile portion P. Asymmetrical profile P2 is defined by a lower convex portion 40 and a lower concave portion 42. Inwardly from lower concave portion 42 is a lower planar portion 44. Thus, lower asymmetric profile P2 also comprises a closed loop, with convex portion 40 and concave portion 42 comprising continuous elements.

The particular configuration of asymmetric profiles P, P2, or their connecting elements, may vary from that illustrated in FIG. 1 depending on consumer preference. While lower asymmetric profile P2 is shown as a square or a rectangle, upper asymmetric profile P is shown as an irregular shape with three straight sides and a curved side. It should be understood that any configuration or shape of an asymmetric profile may be formed in door skin 30. Furthermore, skin 30 may include any number of asymmetric profiles, thereby simulating multi-panel doors. In addition, skin 30 may include a wood grain pattern, as shown in FIG. 1. As well known in the art, a wood grain pattern may be embossed or formed in skin 30, or a veneer or paper overlay may be secured to exterior surface 31.

Skin 50 is substantially identical to skin 30, as best shown in FIG. 2. Thus, skin 50 includes an outer planar portion 52, an upper convex portion 54, an upper concave portion 56, and an upper inner planar portion 58 within an asymmetric profile defined by the convex portion 54 and the concave portion 56 and their connecting elements. The other portions of skin 50 may be understood from FIG. 1 in that skin 50 is essentially a mirror image of skin 30. Thus, skin 50 may also include any configuration or shape of asymmetric profiles, but preferably corresponds to the configurations formed in skin 30 so that convex and concave portions of skin 30 are aligned with convex and concave portions of skin 50, as shown in FIG. 2. The use of double skins, with the skins being mirror images of each other, and both including asymmetric elements, provides a door that is stable under virtually all conditions of temperature and humidity, and is also aesthetically pleasing for consumers. Specifically, the asymmetry allows the portion of door 10 that is disposed inwardly from frame 12 to warp in response to temperature and humidity conditions without warping frame 12. In this way, frame 12 remains in its original planar configuration.

Skins 30, 50 are secured to opposing sides of frame 12 at the interior surface 33, 53 of outer planar areas 32, 52, respectively, and to the interior surface 33, 53 corresponding to an intermediate rail (or lock rail) 22. Skins 30 and 50 are preferably molded from a wood composite, such as medium density fiberboard. The skins 30 and 50 preferably are identical. In one embodiment of the present invention, a plate element 70 is disposed between and secured to interior surface 33 of inner planar portions 38, 58 of skins 30, 50, respectively, as best shown in FIG. 2. Plate element 70 provides stability to skins 30, 50 without hindering the warping of asymmetric profile P adjacent to the plate element 70. A second plate element 70 may also be disposed between and secured to interior surface 33 of lower inner planar portion 44 and the corresponding lower inner planar portion on skin 50. The asymmetric profiles P, P2 may warp in response to temperature and humidity conditions without affecting either perimeter frame 12 or inner planar portions 38, 58 with their plate elements. And likewise, inner planar portions 38, 58 with plates 70 secured to them, do not affect the warping of the asymmetric elements. Plates 70 provide additional strength and stability to door 10, regardless of the temperature and humidity conditions of the structure in which the door is installed. Plates 70 are formed from wood, wood composite, foam and like materials used to form a door core. The plate 70 is preferably adhesively secured to the adjacent door skins.

As best shown in FIG. 2, perimeter frame 12 has a predetermined width or thickness, and the distance between convex portion 34 and convex portion 54, shown by arrow d1, is greater than the width of perimeter frame 12, shown by arrow d2. The distance between concave portions 36 and 56, shown by arrow d3, is less than the width of perimeter frame 12. The distance between inner planar portion 38 and inner planar portion 58 (with plate 70 disposed between them), shown by arrow d4, is less than the distance between convex portions 34 and 54 (d1), but is greater than the distance between concave portions 36 and 56 (d3). Also, it can be seen from FIG. 2 that the plate 70 secured to skins 30 and 50 is longitudinally spaced from rail 14, thus providing a hollow space encompassing planar portions 32, convex portions 34, and concave portions 36.

In addition, the caliper of skin 30 at convex portion 34 is less than the caliper of skin 30 at outer planar area 32 or inner planar area 38. Convex portion 34 extends outwardly beyond the plane of outer planar area 32 relative to exterior surface 31. Concave portion 36 extends inwardly from the plane of outer planar area 32 relative to exterior surface 31. Inner planar area 38 lies on a plane spaced from the plane of outer planar area 32, and is preferably recessed from outer planar area 32, as shown in FIG. 2. Concave portion 36 may also extend inwardly from the plane of inner planar area 38, creating a relatively small distance d3 between concave portions 36, 56, as noted above.

Similarly, the caliper of skin 50 at convex portion 54 is less than the caliper of skin 50 at outer planar area 52 or inner planar area 58. Convex portion 54 extends outwardly beyond the plane of outer planar area 52 relative to exterior surface 51. Concave portion 56 extends inwardly from the plane of outer planar area 52 relative to exterior surface 51. Inner planar area 58 lies on a plane spaced from the plane of outer planar area 52, and is preferably recessed from outer planar area 52. Concave portion 56 may also extend inwardly from the plane of inner planar area 58, as with concave portion 36 and thereby defining distance d3.

The configuration and alignment of the lower asymmetric profile P2, with respect to the convex and concave portions, is substantially the same as that discussed above for the upper asymmetric profile P with respective convex and concave portions, and the inner planar portion with its plate, aligned accordingly. It should be understood that the configuration of lower asymmetric profile P2 may vary depending on consumer preference.

Figure 3:
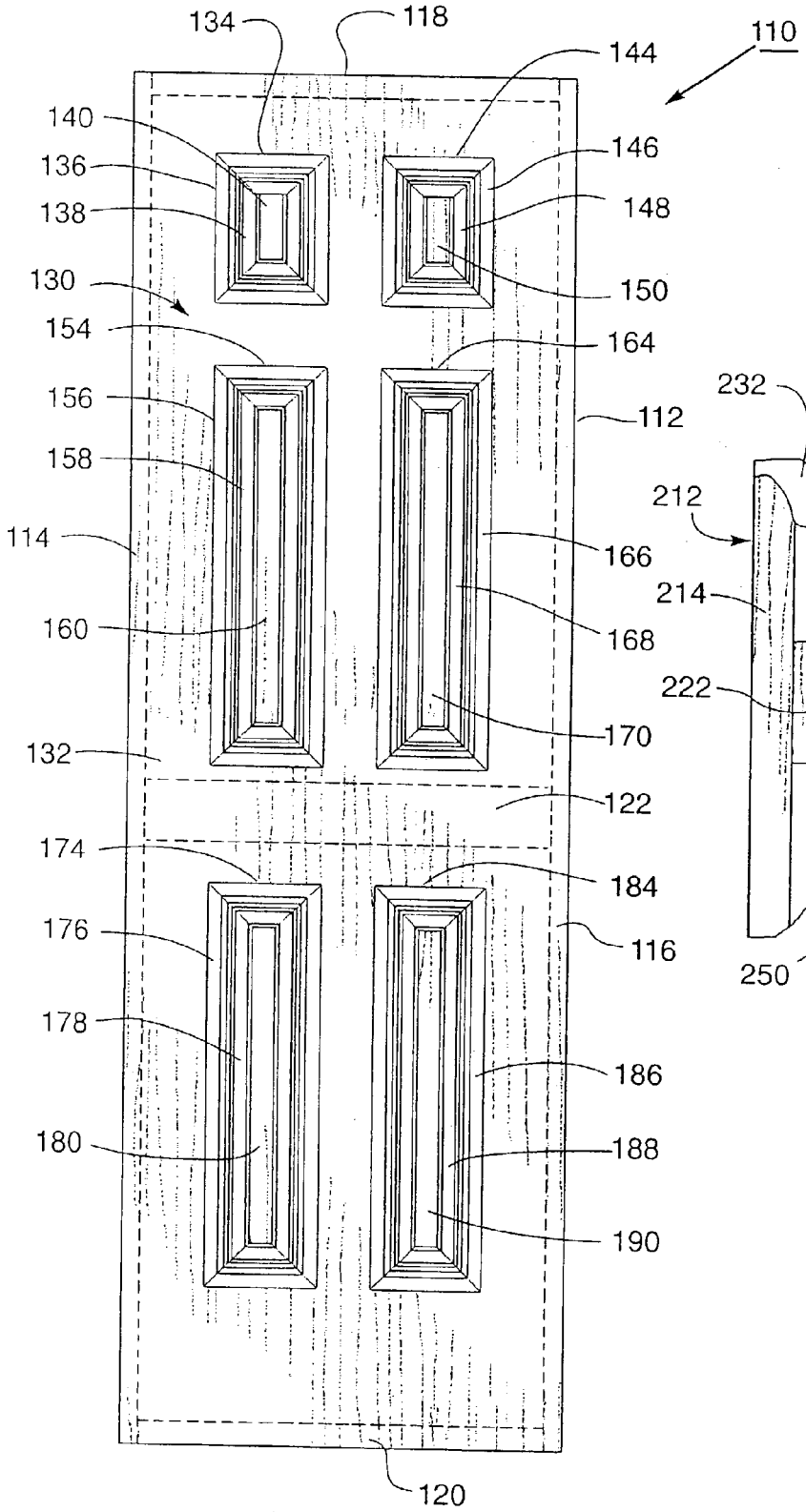
FIG. 3 is an elevational view of a door according to a second embodiment.

As best shown in FIG. 3, a second embodiment of the present invention provides for a door 110 having a perimeter frame 112, and a plurality of upper asymmetric elements 134, 144 and inner planar elements 140, 150, a plurality of intermediate asymmetric elements 154, 164 and inner planar elements 160, 170, and a plurality of lower asymmetric elements 174, 184 and inner planar elements 180, 190. Perimeter frame 112 includes a pair of vertical stiles 114, 116 and a pair of horizontal rails 118, 120. Door 110 may also include an intermediate rail 122 extending between stiles 114, 116 and appropriately secured thereto. A pair of skins 130 are appropriately secured to opposing sides of perimeter frame 112 and to intermediate rail 122, as described above for door 10. Although only one skin 130 is shown in FIG. 3, it should be understood that a second skin is secured to the opposite side of frame 112, and is preferably a mirror image of skin 130 just as skin 50 is preferably a mirror image of skin 30 on door 10. Each of skins 130 is manufactured from a molded wood composite, such as medium density fiberboard.

Each of skins 130 includes a perimeter planar area 132, which may be secured to perimeter frame 112. Skin 130 includes a pair of upper asymmetric profiles 134, 144, a pair of intermediate asymmetric profiles 154, 164, and a pair of lower asymmetric profiles 174, 184. Note that asymmetric profiles 134, 144, 154, 164, 174 and 184 may differ in size and shape. For example, as shown in FIG. 3, upper asymmetric profiles 134, 144 are smaller than intermediate and lower asymmetric profiles 154, 164, and 174, 184, respectively. The differences in size and shape are for illustrative and explanatory purposes only, and are immaterial to the functionality of door 110.

As described above for door 10, each asymmetric profile on door 110 includes a closed loop convex portion integral with and connected to a closed loop concave portion. Each concave portion is disposed about an inner planar portion. For example, profile 134 includes a closed loop convex portion 136 connected to a closed loop concave portion 138, and an enclosed inner planar portion 140. Profile 144 includes a closed loop convex portion 146 connected to a closed loop concave portion 148, and an enclosed inner planar portion 150.

Intermediate asymmetric profiles 154, 164 include, respectively, closed loop convex portions 156, 166, integral with and connected to closed loop concave portions 158, 168, and enclosed inner planar portions 160, 170. Lower asymmetric profiles 174, 184 include closed loop convex portions 176, 186, integral with and connected to closed loop concave portions 178, 188, and disposed about or enclosing inner planar portions 180, 190, respectively.

As shown in FIG. 3, the closed loop asymmetric profiles are of a generally elongated rectangular configuration. However, the profile configurations of door 110 may have any desired size and shape, depending on consumer preference. For example, the asymmetric profiles may be round, square, rectangular, irregular, or a combination of such shapes (as in asymmetric profile P in FIG. 1). In order to allow for appropriate warping of door 110, without distorting or warping perimeter frame 112, the profiles need only be closed loop. Each profile includes a convex portion, a concave portion connected to the convex portion, and an enclosed inner planar portion.

Preferably, the opposing skins 130 are secured to frame 112 so that skins 130 have a mirror image when viewed in cross-section (as shown in FIG. 2 for door 10). Skins 130 are therefore secured to frame 112 in a similar manner as described above for door 10. Furthermore, door 110 may also include plates secured between the pair of skins 130 between the enclosed inner planar portions 140, 150, 160, 170, 180, 190 and corresponding inner planar portions of the other skin 130 securing to the opposing side of frame 112, as discussed above. Furthermore, door 110 may also include a wood grain pattern, as shown in FIG. 3.

Figure 4:
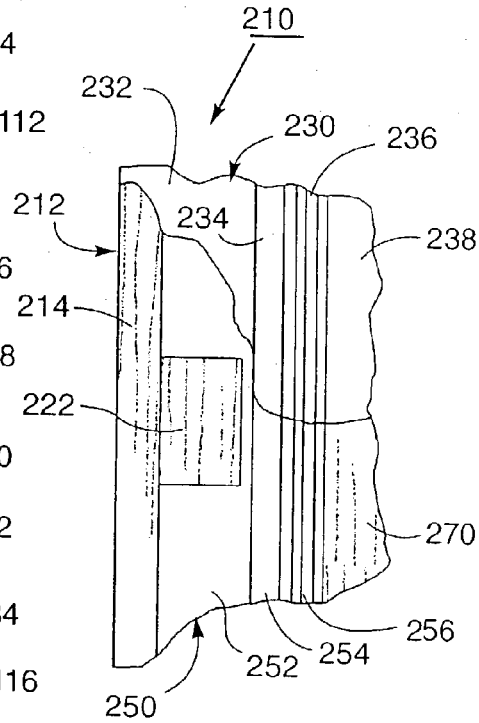
FIG. 4 is a fragmentary exploded view of a door according to a third embodiment.

As best shown in FIG. 4, a third embodiment of the present invention provides for a door 210 having a lock block 222 secured to a stile 214, as opposed to an intermediate rail or lock rail extending fully between the vertical stiles (as in doors 10 and 110). A second lock block (not shown) may be secured to the opposing stile on the opposite side of door 210. Except for the omission of an intermediate rail extending fully between opposing stiles, and the inclusion of at least one lock block 222, the configuration of door 210 is identical to that described for doors 10 and 110. With two lock blocks, door 210 may have a lock set secured on either side of door 210.

Therefore, door 210 includes a full perimeter frame 212, which includes stile 214 to which block 222 is secured. A pair of outer skins 230, 250 are secured to opposing sides of frame 212. For purposes of discussion, skin 230 is a "front" skin, and skin 250 is a "rear" skin. Skins 230, 250 are mirror images of each other, as discussed for doors 10 and 110. Skin 230 includes an outer perimeter planar area or portion 232, and skin 250 includes an outer perimeter planar area or portion 252. Outer perimeter portions 232, 252 are appropriately secured to frame 212 and to the lock block 222, as well as a lock block opposite lock block 222 on the opposing stile (not shown).

The asymmetrical design or portion for skin 230 includes a convex portion 234 and a concave portion 236, as described above. The asymmetrical design or profile for skin 250 includes a convex portion 254 and a concave portion 256. The respective convex and concave portions of the skins are aligned with each other, as discussed above and as illustrated for the door 10 in FIG. 2.

The convex and concave portions extend continuously, without a break, for the full length of skins 230, 250, and are disposed inwardly from outer perimeter portions 232, 252, respectively. The convex and concave elements therefore provide relatively long closed loops compared to the shorter closed loops of doors 10 and 10. Without a transversely extending intermediate or lock rail, door 210 may have such full-length asymmetric portions in skins 230, 250.

Each skin 230, 250 includes an inner planar area adjacent to concave portions of the skins, as described above. For example, skin 230 includes an inner planar portion 238 and skin 250 includes an inner planar portion 258. A plate 270 may be secured between inner planar portions 238, 258. Plate 270 provides stability for door 210, as explained above. Plate 270 may extend fully within the asymmetrical profile of door 210, adjacent concave portions 236, 256, without restricting warping of the aligned asymmetrical portions in response to temperature and humidity conditions.

Certain aspects of the present invention have been explained with respect to specific embodiments. However, it will be apparent to one of ordinary skill in the art that various modifications and variations can be made in construction or configuration of the present invention without departing from the scope or spirit of the invention. Therefore, it is intended that the present invention cover all such modifications and variations, provided they come within the scope of the following claims and their equivalents.

What is claimed is:

1. A hollow core door, comprising:

a perimeter frame;

first and second molded wood composite skins, each of said skins having an exterior surface and an interior surface secured to opposing sides of said frame, wherein at least one of said skins has an outer planar area, an inner planar area, and an asymmetric profile surrounding said inner planar area and interconnecting and integral with said outer planar area and said inner planar area, said asymmetric profile area having a convex portion extending outwardly from said exterior surface and relative to the plane of said outer planar area, wherein said convex portion has a first caliper, said outer planar area has a second caliper, and said first caliper is less than said second caliper and a plate element disposed between the interior surfaces of said inner planar areas of said first and second skins.

2. The door of claim 1, wherein said asymmetric profile further comprises a concave portion extending inwardly from and relative to the plane of said outer planar area.

3. The door of claim 2, wherein said concave portion extends from and is integral with said inner planar area and said convex portion.

4. The door of claim 3, wherein said convex portion extends from and is integral with said outer planar area and said concave portion.

5. The door of claim 1, wherein said inner planar area defines a rectangular area.

6. The door of claim 1, wherein said door skin comprises at least two of said inner planar areas and at least two of said corresponding asymmetric profiles.

7. The door of claim 6, wherein at least two of said inner planar areas have differing configurations.

8. The door of claim 1, wherein said first skin and said second skin are secured to said frame to be mirror images of each other.

9. The door of claim 8, wherein said first and said second skins are secured to said frame so that said inner planar area and said asymmetric profile of said first skin is aligned with said inner planar area and said asymmetric profile of said second skin.

10. The door of claim 1, wherein said outer planar areas of the interior surface of said skins are secured to said frame.

11. The door of claim 1, wherein said plate is spaced from said frame and said asymmetric profile and defines a hollow space within said door.

12. The door of claim 11, wherein said frame further comprises an intermediate rail extending substantially perpendicular to and between said stiles.

13. The door of claim 1, wherein said inner planar area lies on a plane spaced from the plane of said outer planar area.

14. The door of claim 13, wherein said inner planar area is inwardly disposed relative to the plane of said outer planar area.

15. A molded wood composite door skin, comprising:

an outer planar area;

an inner planar area; and an asymmetric profile area surrounding said inner planar area and interconnecting and integral with said outer planar area and said inner planar area, said asymmetric profile area having a convex portion extending outwardly from and relative to the plane of said outer planar area, a concave portion extending inwardly from and relative to the plane of said outer planar area, said convex portion has a first caliper, said outer planar area has a second caliper, and said first caliper is less than said second caliper and a plate element disposed between the interior surfaces of said inner planar areas of said first and second skins.

16. The door skin of claim 15, wherein said inner planar area has a caliper that is greater than said first caliper.

17. The door skin of claim 15, wherein said concave portion extends from and is integral with said inner planar area and said convex portion.

18. The door skin of claim 17, wherein said convex portion extends from and is integral with said outer planar area and said concave portion.

19. The door skin of claim 15, wherein said inner planar area defines a rectangular area.

20. The door skin of claim 15, further comprising at least two of said inner planar areas and at least two of said corresponding asymmetric profile areas.

21. The door skin of claim 20, wherein at least two of said inner planar areas have differing configurations.

22. The door skin of claim 15, wherein said inner planar area lies on a plane spaced from the plane of said outer planar area.

23. Double skin door apparatus, comprising:

a door frame having opposing sides;

a first molded wood composite door skin secured to one side of said frame, said first door skin having a first asymmetrical profile including a convex portion and a concave portion, said first asymmetrical profile surrounding and integral with a first planar area;

a second molded wood composite door skin secured to an opposing side of said frame and spaced from said first door skin, said second door skin having a second asymmetrical profile including a convex portion and a concave portion, said second asymmetrical profile surrounding and integral with a second planar area, said convex portions of said first and second door skins defining a first distance and said concave portions of said first and second door skins defining a second distance, wherein said first distance is greater than said second distance, wherein said asymmetric profiles each includes an apex extending outwardly relative to the associated planar area and said apexes spaced a distance exceeding the distance said planar areas are spaced; and a plate disposed between said first and second door skins, wherein said first and second skins further comprise outer planar areas, said outer planar areas surrounding and integral with said first and second asymmetrical profiles, respectively, said first and second outer planar areas are secured to said opposing sides of said frame, wherein said first and second outer planar areas are spaced a distance exceeding the distance said first and second planar areas are spaced.

24. Double skin door apparatus, comprising:

a door frame having opposing sides;

a first molded wood composite door skin secured to one side of said frame, said first door skin having a first asymmetrical profile including a convex portion and a concave portion, said first asymmetrical profile surrounding and integral with a first planar area;

a second molded wood composite door skin secured to an opposing side of said frame and spaced from said first door skin, said second door skin having a second asymmetrical profile including a convex portion and a concave portion, said second asymmetrical profile surrounding and integral with a second planar area, said convex portions of said first and second door skins defining a first distance and said concave portions of said first and second door skins defining a second distance, wherein said first distance is greater than said second distance, wherein said asymmetric profiles each includes an apex extending outwardly relative to the associated planar area and said apexes spaced a distance exceeding the distance said planar areas are spaced; and a plate disposed between said first and second door skins.

* * * * *